US008236470B2

(12) United States Patent
Ueno et al.

(10) Patent No.: US 8,236,470 B2
(45) Date of Patent: Aug. 7, 2012

(54) TONER

(75) Inventors: Yoshihiro Ueno, Wakayama (JP); Takashi Kubo, Wakayama (JP); Yasunori Inagaki, Wakayama (JP); Yoshitomo Kimura, Wakayama (JP)

(73) Assignee: Kao Corporation, Tokyo (JP)

( * ) Notice: Subject to any disclaimer, the term of this patent is extended or adjusted under 35 U.S.C. 154(b) by 691 days.

(21) Appl. No.: 12/094,737

(22) PCT Filed: Nov. 28, 2006

(86) PCT No.: PCT/JP2006/323712

§ 371 (c)(1), (2), (4) Date: May 22, 2008

(87) PCT Pub. No.: WO2007/063847

PCT Pub. Date: Jun. 7, 2007

(65) Prior Publication Data

US 2010/0015545 A1 Jan. 21, 2010

(30) Foreign Application Priority Data

Dec. 2, 2005 (JP) ..... 2005-349085

(51) Int. Cl.
*G03G 9/087* (2006.01)

(52) U.S. Cl. ..... 430/109.4; 430/111.4

(58) Field of Classification Search ..... 430/109.4
See application file for complete search history.

(56) References Cited

U.S. PATENT DOCUMENTS

| | | | | |
|---|---|---|---|---|
| 4,863,824 | A * | 9/1989 | Uchida et al. | 430/109.4 |
| 4,981,939 | A | 1/1991 | Matsumura et al. | |
| 6,326,115 | B1 | 12/2001 | Nakanishi et al. | |
| 6,509,130 | B1 * | 1/2003 | Semura et al. | 430/109.4 |
| 6,653,435 | B1 | 11/2003 | Aoki et al. | |
| 7,232,636 | B2 * | 6/2007 | Semura et al. | 430/109.4 |
| 7,358,023 | B2 * | 4/2008 | Yamazaki et al. | 430/109.4 |
| 2003/0022088 | A1 | 1/2003 | Semura et al. | |
| 2005/0214670 | A1 * | 9/2005 | Matsumoto et al. | 430/109.4 |
| 2007/0281235 | A1 | 12/2007 | Ono et al. | |

FOREIGN PATENT DOCUMENTS

| | | |
|---|---|---|
| EP | 1 345 086 A2 | 9/2003 |
| JP | 63-127253 | 5/1988 |
| JP | 02-082267 | 3/1990 |
| JP | 03-267946 | 11/1991 |
| JP | 04-070765 | 3/1992 |
| JP | 07-286139 | 10/1995 |
| JP | 08-020636 | 1/1996 |
| JP | 10-239903 | 9/1998 |
| JP | 11-133668 | 5/1999 |
| JP | 2001-098055 | 4/2001 |
| JP | 2002-169331 | 6/2002 |
| JP | 2002-287427 | 10/2002 |
| JP | 2004-280084 A | 10/2004 |
| WO | WO 2005/057293 A1 | 6/2005 |

OTHER PUBLICATIONS

English language translation of JP 04-70765 (Mar. 1992).*

U.S. Appl. No. 12/302,843, filed Nov. 28, 2008, Kimura, et al.

Office Action mailed Aug. 12, 2011 in corresponding Japanese Application No. 2005-349085, filled Dec. 2, 2005, (with English translation).

Supplementary European Search Report issued in corresponding EP Application No. 06833516.5.

Request for Inspection of File Record issued Nov. 15, 2011 and Observations by Third Party issued Oct. 20, 2011, in Japanese Patent Application No. 2005-349085 (with English-language translation).

Chinese Office Action issued Nov. 11, 2011, in Patent Application No. 201010586670.8 (with English-language translation).

Office Action mailed Apr. 2, 2012, in corresponding Japanese Patent Application 2005-349085 (with English-language translation).

Office Action Mailed May 23, 2012, in corresponding Chinese Patent Application 201010586670.8 (with English Translation) (8 pp.).

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A toner containing a resin binder and a colorant, wherein the resin binder contains a polyester (A) having a softening point Tm(A) of from 100° to 160° C., and a polyester (B) having a softening point Tm(B) of from 80° to 120° C., the softening point of which is lower than that of the polyester (A) by 5° C. or more, each polyester obtained by polycondensing an alcohol component and a carboxylic acid component, wherein the polyester (A) and/or (B) is a polyester obtained by polycondensing an alcohol component consisting essentially of an aliphatic alcohol, wherein the alcohol component contains a dihydric alcohol component containing 1,2-propanediol in an amount of 65% by mol or more, and a carboxylic acid component. The toner of the present invention is usable in the development or the like of a latent image formed in electrophotography, electrostatic recording method, electrostatic printing method, or the like.

18 Claims, No Drawings

TONER

TECHNICAL FIELD

The present invention relates to a toner usable in the development of a latent image formed in, for example, electrophotography, electrostatic recording method, electrostatic printing method, or the like.

BACKGROUND ART

With the advancement in speeding-up and conservation of energy of a machine, a toner having excellent low-temperature fixing ability is in demand. On the other hand, with the advancement of speeding-up, a toner also having offset resistance, which is a contradictory property to a low-temperature fixing ability, is in demand. In order to accomplish both of these properties, a polyester blend system using an aromatic alcohol has been proposed. However, the aromatic polyester has a disadvantage in that the aromatic polyester has a rigid structure, so that the pulverizability upon the production of the toner is worsened, whereby not facilitating the pulverization from the viewpoint of the production of toners having smaller particle sizes with the advancement in high image quality.

In view of the above, a method including the step of blending a low-molecular weight polyester with a high-molecular weight polyester, using an aliphatic alcohol having excellent pulverizability as a monomer has been employed (see Patent Publication 1).

Patent Publication 1: JP-A-2002-287427

SUMMARY OF THE INVENTION

The present invention relates to a toner containing a resin binder and a colorant, wherein the resin binder contains a polyester (A) having a softening point Tm(A) of from 100° to 160° C., and a polyester (B) having a softening point Tm(B) of from 80° to 120° C., the softening point of which is lower than that of the polyester (A) by 5° C. or more, each polyester obtained by polycondensing an alcohol component and a carboxylic acid component, wherein the polyester (A) and/or (B) is a polyester obtained by polycondensing an alcohol component consisting essentially of an aliphatic alcohol, wherein the alcohol component contains a dihydric alcohol component containing 1,2-propanediol in an amount of 65% by mol or more, and a carboxylic acid component.

DETAILED DESCRIPTION OF THE INVENTION

While it is desired to satisfy both of low-temperature fixing ability and offset resistance in an even higher level, satisfaction of these properties would certainly accompany the lowering of the glass transition temperature, especially in a method including the step of blending a low-molecular weight resin, thereby resulting in worsening of the storage property such as the toner is undesirably aggregated.

Especially in a case where a low-molecular polyester is synthesized using an aliphatic alcohol, the resulting polyester is likely to have a low glass transition point and be deficient in storage property because of the structural characteristic of the aliphatic alcohol-based polyester.

Therefore, in a method including the step of blending a low-molecular weight polyester with a high-molecular weight polyester, using an aliphatic alcohol as a monomer, it would be difficult to satisfy the offset resistance and the low-temperature fixing ability at a high level, and secure storage property.

In addition, the polyester obtained from an aliphatic alcohol has a large number of ester bonds in the molecule, a disadvantage that the polyester has high hygroscopicity, thereby resulting in lowering of triboelectric chargeability under high-temperature, high-humidity conditions is more likely to take place.

The present invention relates to a toner being excellent in any one of low-temperature fixing ability, offset resistance, triboelectric charge stability under high-temperature, high-humidity conditions, and storage property.

The toner of the present invention exhibits excellent effects in any one of low-temperature fixing ability, offset resistance, triboelectric charge stability under high-temperature, high-humidity conditions, and storage property.

The toner of the present invention contains at least a resin binder and a colorant, wherein the resin binder contains two kinds of polyesters having specified softening points, i.e. a polyester (A) and a polyester (B) given hereinbelow.

The polyester (A) is a polyester having a softening point Tm(A) of from 100° to 160° C., preferably from 120° to 160° C., more preferably from 130° to 155° C., and even more preferably from 135° to 155° C. On the other hand, the polyester (B) is a polyester having a softening point Tm(B) of from 80° to 120° C., preferably from 80° C. or higher and lower than 120° C., more preferably from 85° to 115° C., and even more preferably from 90° to 110° C., the softening point of which is lower than that of the polyester (A). The difference (ΔTm) of Tm(A) and Tm(B) is 5° C. or more, preferably 10° C. or more, more preferably from 15° to 55° C., and even more preferably 20° to 50° C. The polyester (A) having a high softening point contributes to the improvement in offset resistance, and the polyester (B) having a low softening point contributes to the improvement in low-temperature fixing ability, respectively, so that a combined use of both of the polyesters is effective in satisfying both of low-temperature fixing ability and offset resistance. A weight ratio of the polyester (A) to the polyester (B) in the resin binder, i.e. polyester (A)/polyester (B), is preferably from 1/9 to 9/1, more preferably from 2/8 to 8/2, and even more preferably from 3/7 to 7/3.

Further, the present invention has a major feature in that the polyester (A) and/or (B) is a polyester obtained by polycondensing an alcohol component containing a dihydric alcohol component containing 1,2-propanediol in an amount of 65% by mol or more, and a carboxylic acid component.

In the present invention, 1,2-propanediol, which is a branched alcohol having 3 carbon atoms usable in the alcohol component is effective in improving low-temperature fixing ability while maintaining offset resistance, as compared to those alcohols having 2 or less carbon atoms, and is effective in preventing the lowering of storage property accompanying the lowering of the glass transition temperature, as compared to those branched alcohols having 4 or more carbon atoms. Surprising effects that the toner can be fixed at a very low temperature are exhibited, thereby improving storage property.

The alcohol component may contain an alcohol other than 1,2-propanediol within the range so as not to impair the effects of the present invention. The 1,2-propanediol is contained in an amount of 65% by mol or more, preferably 70% by mol or more, more preferably 80% by mol or more, and even more preferably 90% by mol or more, of the dihydric alcohol component. The dihydric alcohol component other than the 1,2-propanediol includes aliphatic dialcohols such as 1,3-propanediol, ethylene glycols having different carbon atoms, a hydrogenated bisphenol A, or an alkylene (2 to 4 carbon atoms) oxide (average number of moles: 1 to 16) adduct, and the like. The dihydric alcohol component is contained in an amount of preferably from 60 to 95% by mol, and more preferably from 65 to 90% by mol, of the alcohol component.

Here, it is preferable that the alcohol component of the polyester (A) contains 1,3-propanediol from the viewpoint of offset resistance. A molar ratio of 1,2-propanediol to 1,3-propanediol in the alcohol component of the polyester (A), i.e. 1,2-propanediol/1,3-propanediol, is preferably from 99/1 to 65/35, more preferably from 95/5 to 70/30, even more preferably from 90/10 to 75/25, and even more preferably from 85/15 to 77/23.

Here, the alcohol component may contain an aromatic alcohol such as an alkylene oxide adduct of bisphenol A, such as polyoxypropylene(2.2)-2,2-bis(4-hydroxyphenyl)propane or polyoxyethylene(2.2)-2,2-bis(4-hydroxyphenyl)propane. However, the alcohol component of the polyester (A) and/or (B) consists essentially of an aliphatic alcohol, and it is preferable that both of the alcohol components of the polyesters (A) and (B) consist essentially of an aliphatic alcohol. The phrase "alcohol component consisting essentially of an aliphatic alcohol" as used herein refers to an alcohol component containing an aliphatic alcohol in an amount of preferably 90% by mol or more, more preferably 95% by mol or more, even more preferably 98% by mol or more, and even more preferably 99% by mol or more.

On the other hand, it is preferable that the carboxylic acid component contains an aliphatic dicarboxylic acid compound having 2 to 4 carbon atoms. The aliphatic dicarboxylic acid compound having 2 to 4 carbon atoms includes adipic acid, maleic acid, malic acid, succinic acid, fumaric acid, citraconic acid, itaconic acid, and acid anhydrides thereof, and the like. Among them, it is more preferable that at least one aliphatic dicarboxylic acid compound selected from the group consisting of succinic acid, fumaric acid, citraconic acid, and itaconic acid is contained. These aliphatic dicarboxylic acid compounds are effective in the improvement of low-temperature fixing ability. In the present invention, among the above-mentioned aliphatic dicarboxylic acid compounds, itaconic acid is preferred.

The above-mentioned aliphatic dicarboxylic acid is contained in an amount of preferably from 0.5 to 20% by mol, and more preferably from 1 to 10% by mol, of the carboxylic acid component, from the viewpoint of the improvement in low-temperature fixing ability and the control in the lowering of the glass transition temperature. Since a polyester obtained by polycondensing an aliphatic carboxylic acid compound containing no aromatic ring with 1,2-propanediol has improvement in compatibility with a releasing agent, filming resistance can be even more enhanced by a combined use with the releasing agent.

Further, it is preferable that the carboxylic acid component contains a rosin. By containing a rosin having a polycyclic aromatic ring, hygroscopicity owned by a conventional aliphatic alcohol-based polyester is lowered, so that an effect against the lowering of triboelectric charges under high-temperature, high-humidity conditions is even more enhanced.

In the present invention, a rosin is a natural resin obtained from pine trees, of which main components are resin acids such as abietic acid, neoabietic acid, palustric acid, pimaric acid, isopimaric acid, sandaracopimaric acid, dehydroabietic acid, and levopimaric acid, and mixtures thereof.

The rosins are roughly classified into a tall rosin obtained from a tall oil produced as a by-product in the process of manufacturing pulp, a gum rosin obtained from a crude turpentine, a wood rosin obtained from stumps of pine tree, and the like. The rosin in the present invention is preferably a tall resin, from the viewpoint of low-temperature fixing ability.

In addition, the rosin may be a modified rosin such as an isomerized rosin, a dimerized rosin, a polymerized rosin, a disproportionate rosin, or a hydrogenated rosin. In the present invention, a so-called crude rosin without being modified is preferably used, from the viewpoint of low-temperature fixing ability and storage property.

It is preferable that the rosin is a purified rosin, from the viewpoint of improvement of storage property and odor.

The purified rosin in the present invention is a rosin from which impurities are removed by a purifying step. The main impurities include 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, 4-(1-methylethyl)benzaldehyde, and the like. In the present invention, peak intensities of three kinds of impurities of those listed above, 2-methylpropane, pentanoic acid, and benzaldehyde, which are detected as volatile components according to headspace GC-MS method, can be used as an index for a purified rosin. Here, the reason why that the volatile components are used as indexes, not in absolute amounts of impurities, is in that the use of the purified rosin in the present invention has an objective of improvement in odor against conventional polyesters using rosins.

Specifically, the purified rosin in the present invention refers to a rosin in which a peak intensity of hexanoic acid is $0.8\times10^7$ or less, a peak intensity of pentanoic acid is $0.4\times10^7$ or less, and a peak intensity of benzaldehyde is $0.4\times10^7$ or less, under measurement conditions for headspace GC-MS method described later. Further, from the viewpoint of storage property and odor, the peak intensity of hexanoic acid is preferably $0.6\times10^7$ or less, and more preferably $0.5\times10^7$ or less. The peak intensity of pentanoic acid is preferably $0.3\times10^7$ or less, and more preferably $0.2\times10^7$ or less. The peak intensity of benzaldehyde is preferably $0.3\times10^7$ or less, and more preferably $0.2\times10^7$ or less.

Further, it is preferable that n-hexanal and 2-pentylfuran are reduced in addition to the three kinds of substances mentioned above, from the viewpoint of storage property and odor. The peak intensity of n-hexanal is preferably $1.7\times10^7$ or less, more preferably $1.6\times10^7$ or less, and even more preferably $1.5\times10^7$ or less. In addition, the peak intensity of 2-pentylfuran is preferably $1.0\times10^7$ or less, more preferably $0.9\times10^7$ or less, and even more preferably $0.8\times10^7$ or less.

As a method of purifying a rosin, a known method can be utilized, and the method includes a method by distillation, recrystallization, extraction or the like, and it is preferable that the rosin is purified by distillation. As a method of distillation, a method described, for example, in JP-A-Hei-7-286139 can be utilized. The method of distillation includes vacuum distillation, molecular distillation, steam distillation, and the like, and it is preferable that the rosin is purified by vacuum distillation. For example, distillation is carried out usually at a pressure of 6.67 kPa or less and at a stilling temperature of from 200° to 300° C., an ordinary simple distillation as well as a method of thin-film distillation, rectification, or the like can be applied. The high-molecular weight compound is removed as a pitch component in an amount of from 2 to 10% by weight, and at the same time an initial distillate is removed in an amount of from 2 to 10% by weight, each based on the charged rosin under ordinary distillation conditions.

The purified rosin has a softening point of preferably from 50° to 100° C., preferably from 60° to 90° C., and even more preferably from 65° to 85° C. In addition, by purifying the rosin, impurities contained in the rosin are removed. The softening point of the purified rosin in the present invention means a softening point determined when a rosin is once melted, and air-cooled for 1 hour under environmental conditions of a temperature of 25° C. and a relative humidity of 50%, in accordance with a method described later.

Further, the purified rosin has an acid value of preferably from 100 to 200 mg KOH/g, more preferably from 130 to 180 mg KOH/g, and even more preferably from 150 to 170 mg KOH/g.

The purified rosin is contained in an amount of preferably from 2 to 50% by mol, more preferably from 5 to 40% by mol, and even more preferably from 10 to 30% by mol, of the carboxylic acid component.

Further, the carboxylic acid component may contain a carboxylic acid compound other than the aliphatic carboxylic acid compound and the rosin mentioned above, within the range that would not impair the effects of the present invention. It is preferable that an aromatic dicarboxylic acid such as phthalic acid, isophthalic acid or terephthalic acid is contained, from the viewpoint of securing the glass transition temperature. The aromatic dicarboxylic acid is contained in an amount of preferably from 40 to 95% by mol, more preferably from 50 to 90% by mol, and even more preferably from 60 to 80% by mol, of the carboxylic acid component.

The polyester of the present invention is preferably a crosslinked polyester. As a crosslinking agent, it is preferable that a trivalent or higher polyvalent raw material monomer is contained in the alcohol component and/or the carboxylic acid component. The trivalent or higher polyvalent raw material monomer is contained in an amount of preferably from 0 to 40% by mol, and more preferably from 5 to 30% by mol, of a total amount of the alcohol component and the carboxylic acid component.

In the trivalent or higher polyvalent raw material monomer, a tricarboxylic or higher polycarboxylic acid compound is preferably trimellitic acid and a derivative thereof, and a trihydric or higher polyhydric alcohol includes pentaerythritol, trimethylolpropane, sorbitol, or alkylene (2 to 4 carbon atoms) oxide (average number of moles: 1 to 16) adducts thereof, and the like. Among them, glycerol is preferred because glycerol not only acts as a crosslinking agent but also is effective in the improvement of low-temperature fixing ability. Glycerol is contained in an amount of preferably from 5 to 40% by mol, and more preferably from 10 to 35% by mol, of the alcohol component, from the above viewpoint.

It is preferable that the polycondensation of an alcohol component with a carboxylic acid component is carried out in the presence of an esterification catalyst. Preferred examples of the esterification catalysts in the present invention include titanium compounds and tin(II) compounds without containing a Sn—C bond. These esterification catalysts can be used alone or in admixture of both kinds.

The titanium compound is preferably a titanium compound having a Ti—O bond, and a compound having an alkoxy group having a total number of carbon atoms of from 1 of 28, an alkenyloxy group having a total number of carbon atoms of from 2 of 28, or an acyloxy group having a total number of carbon atoms of from 1 of 28 is more preferable.

Specific examples of the titanium compound include titanium diisopropylate bis(triethanolaminate) [$Ti(C_6H_{14}O_3N)_2(C_3H_7O)_2$], titanium diisopropylate bis(diethanolaminate) [$Ti(C_4H_{10}O_2N)_2(C_3H_7O)_2$], titanium dipentylate bis(triethanolaminate) [$Ti(C_6H_{14}O_3N)_2(C_5H_{11}O)_2$], titanium diethylate bis(triethanolaminate) [$Ti(C_6H_{14}O_3N)_2(C_2H_5O)_2$], titanium dihydroxyoctylate bis(triethanolaminate) [$Ti(C_6H_{14}O_3N)_2(OHC_8H_{16}O)_2$], titanium distearate bis(triethanolaminate) [$Ti(C_6H_{14}O_3N)_2(C_{18}H_{37}O)_2$], titanium triisopropylate triethanolaminate [$Ti(C_6H_{14}O_3N)_1(C_3H_7O)_3$], titanium monopropylate tris(triethanolaminate) [$Ti(C_6H_{14}O_3N)_3(C_3H_7O)_1$], and the like. Among them, titanium diisopropylate bis(triethanolaminate), titanium diisopropylate bis(diethanolaminate) and titanium dipentylate bis(triethanolaminate) are preferable, which are available as marketed products of Matsumoto Trading Co., Ltd.

Other specific examples of the preferred titanium compound include tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyl dihydroxyoctyl titanate [$Ti(C_8H_{17}O)_2(OHC_8H_{16}O)_2$], dimyristyl dioctyl titanate [$Ti(C_{14}H_{29}O)_2(C_8H_{17}O)_2$], and the like. Among them, tetrastearyl titanate, tetramyristyl titanate, tetraoctyl titanate and dioctyl dihydroxyoctyl titanate are preferable. These titanium compounds can be obtained by, for example, reacting a titanium halide with a corresponding alcohol, and are also available as marketed products of Nisso, or the like.

The titanium compound is present in an amount of preferably from 0.01 to 1.0 part by weight, and more preferably from 0.1 to 0.5 parts by weight, based on 100 parts by weight of a total amount of the alcohol component and the carboxylic acid component.

The tin(II) compound without containing a Sn—C bond is preferably a tin(II) compound having a Sn—O bond, a tin(II) compound having a Sn—X bond, wherein X is a halogen atom, or the like, and the tin(II) compound having a Sn—O bond is more preferable.

The tin (II) compound containing a Sn—O bond includes tin(II) carboxylate having a carboxylate group having 2 to 28 carbon atoms, such as tin(II) oxalate, tin(II) diacetate, tin(II) dioctanoate, tin(II) dilaurate, tin(II) distearate, and tin(II) dioleate; dialkoxy tin(II) having an alkoxy group having 2 to 28 carbon atoms, such as dioctyloxy tin(II), dilauroxy tin(II), distearoxy tin(II), and dioleyloxy tin(II); tin(II) oxide; tin(II) sulfate; and the like, and the compound containing a Sn—X bond, wherein X is a halogen atom, includes tin(II) halides, such as tin(II) chloride and tin(II) bromide, and the like. Among them, a fatty acid tin(II) represented by the formula $(R^1COO)_2Sn$, wherein $R^1$ is an alkyl group or alkenyl group having 5 to 19 carbon atoms, a dialkoxy tin(II) represented by the formula $(R^2O)_2Sn$, wherein $R^2$ is an alkyl group or alkenyl group having 6 to 20 carbon atoms, and tin(II) oxide represented by SnO are preferable, and the fatty acid tin(II) represented by the formula $(R^1COO)_2Sn$ and tin(II) oxide are more preferable, and tin(II) dioctanoate, tin(II) distearate, and tin (II) oxide are even more preferable, from the viewpoint of an effect of initial rise of triboelectric charges and catalytic ability.

The tin(II) compound is present in an amount of preferably from 0.01 to 1.0 part by weight, more preferably from 0.1 to 0.8 parts by weight, and even more preferably from 0.2 to 0.6 parts by weight, based on 100 parts by weight of the total amount of the alcohol component and the carboxylic acid component.

When the titanium compound and the tin(II) compound are used together, the titanium compound and the tin(II) compound are present in a total amount of preferably from 0.01 to 1.0 part by weight, and more preferably from 0.1 to 0.5 parts by weight, based on 100 parts by weight of the total amount of the alcohol component and the carboxylic acid component.

The polycondensation of the alcohol component and the carboxylic acid component can be carried out, for example at a temperature of from 180° to 250° C. in an inert gas atmosphere in the presence of the above-mentioned esterification catalyst. The softening point of the polyester can be adjusted by the reaction time.

The polyesters (A) and (B) have a glass transition temperature of preferably from 45° to 75° C., and more preferably from 50° to 70° C., and even more preferably from 50° to 65° C., from the viewpoint of fixing ability, storage property, and durability. The polyesters have an acid value of preferably from 1 to 80 mg KOH/g, and more preferably from 10 to 50 mg KOH/g, from the viewpoint of triboelectric chargeability and environmental stability.

In the present invention, it is preferable that the polyesters (A) and (B) are amorphous polyesters different from crystalline polyesters. The term "amorphous polyester" as used herein refers to a polyester having a difference between a softening point and a glass transition temperature (Tg) of 30° C. or more.

Incidentally, the polyesters (A) and (B) may be a modified polyester. The term "a modified polyester" refers to a polyester which is grafted or blocked with phenol, urethane, epoxy or the like according to methods described in, for example, JP-A-Hei-11-133668, JP-A-Hei-10-239903, JP-A-Hei-8-20636, and the like.

The resin binder may be used together with a known resin binder within a range so as not to impair the effects of the present invention, for example, other resin such as a vinyl resin such as a styrene-acrylic resin, an epoxy resin, a polycarbonate, or a polyurethane. The polyester (A) and the polyester (B) are contained in a total amount of preferably 70% by weight or more, more preferably 80% by weight or more, even more preferably 90% by weight or more, and even more preferably essentially 100% by weight, of the resin binder.

As the colorant, all of the dyes, pigments and the like which are used as colorants for toners can be used, and a carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, or the like can be used. In the present invention, the toner may be any of black toner and color toner. The colorant is contained in an amount of preferably from 1 to 40 parts by weight, and more preferably from 2 to 10 parts by weight, based on 100 parts by weight of the resin binder.

It is preferable that the toner of the present invention contains a releasing agent. The releasing agent includes synthetic waxes such as polypropylene wax, polyethylene wax and Fischer-Tropsch wax; coal waxes such as montan wax; petroleum waxes such as paraffin waxes; waxes such as alcohol waxes; and natural ester waxes such as carnauba wax, rice wax, and candelilla wax. These waxes may be used alone or in admixture of two or more kinds. The releasing agent is contained in an amount of preferably from 0.5 to 10 parts by weight, and more preferably from 1 to 8 parts by weight, based on 100 parts by weight of the resin binder.

The releasing agent has a melting point of preferably from 50° to 120° C., and more preferably at a temperature of equal to or lower than a softening point of the resin binder, when taking the influences to blocking resistance and low-temperature fixing ability of the resin binder into consideration.

As the charge control agent, any one of negative chargeable and positively chargeable charge control agents can be used. The negatively chargeable charge control agent includes, for example, metal-containing azo dyes, copper phthalocyanine dyes, metal complexes of alkyl derivatives of salicylic acid, nitroimidazole derivatives, and the like. The positively chargeable charge control agent includes, for example, Nigrosine dyes, triphenylmethane-based dyes, quaternary ammonium salt compounds, polyamine resins, imidazole derivatives and the like. In addition, a polymeric charge control agent such as a resin can be used. The charge control agent is contained in an amount of preferably from 0.1 to 8 parts by weight, and more preferably from 0.2 to 5 parts by weight, based on 100 parts by weight of the resin binder.

The toner of the present invention may further properly contain an additive such as a charge control agent, a magnetic powder, a fluidity improver, an electric conductivity modifier, an extender, a reinforcing filler such as a fibrous substance, an antioxidant, an anti-aging agent, or a cleanability improver.

The toner of the present invention may be a toner obtained by any of conventionally known methods such as a melt-kneading method, an emulsion phase-inversion method, and a polymerization method, and a pulverized toner produced by the melt-kneading method is preferable, from the viewpoint of productivity and dispersibility of a colorant. Incidentally, in the case of a pulverized toner produced by the melt-kneading method, the toner can be produced by homogeneously mixing raw materials such as a resin binder, a colorant, and a releasing agent with a mixer such as a Henschel mixer, thereafter melt-kneading the mixture with a closed kneader, a single-screw or twin-screw extruder, an open roller-type kneader, or the like, cooling, pulverizing, and classifying the product. It is preferable that the toner has a volume-median particle size of preferably from 3 to 15 μm. The term "volume-median particle size ($D_{50}$)" as used herein means a particle size at 50% when calculated from particle sizes of smaller particle sizes in the cumulative volume frequency calculated in percentage on the volume basis.

Furthermore, the toner of the present invention may be subjected to an external addition treatment with an external additive such as fine inorganic particles of silica, alumina, titania, zirconia, tin oxide, zinc oxide, and the like, and fine organic particles such as fine resin particles.

As the external additive, silica having a small specific gravity is preferable, from the viewpoint of preventing embedment. The silica is preferably a hydrophobic silica subjected to a hydrophobic treatment, from the viewpoint of environmental stability. The method for hydrophobic treatment is not particularly limited, and an agent for the hydrophobic treatment includes hexamethyldisilazane (HMDS), dimethyldichlorosilane (DMDS), a silicone oil, methyl triethoxysilane, and the like. It is preferable that the processing amount of the agent for the hydrophobic treatment is from 1 to 7 mg/m$^2$ per surface area of the fine inorganic particles.

The external additive has a number-average particle size of preferably from 3 to 300 nm, and more preferably from 5 to 100 nm, from the viewpoint of triboelectric chargeability and prevention of a photosensitive member from being damaged.

The external additive is contained in an amount of preferably from 0.01 to 10 parts by weight, and more preferably from 0.1 to 5 parts by weight, based on 100 parts by weight of the toner matrix particles.

The toner of the present invention can be used as a toner for monocomponent development, or as a two component developer prepared by mixing the toner with a carrier.

In the present invention, the carrier is preferably a carrier having a low saturation magnetization, which forms a soft magnetic brush, from the viewpoint of the image properties. The saturation magnetization of the carrier is preferably from 40 to 100 Am$^2$/kg, and more preferably from 50 to 90 Am$^2$/kg. The saturation magnetization is preferably 100 Am$^2$/kg or less from the viewpoint of controlling the hardness of the magnetic brush and retaining the tone reproducibility, and preferably 40 $Am^2/kg$ or more from the viewpoint of preventing the carrier adhesion and the toner scattering.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; and glass beads; and the like. Among them, iron powder, magnetite, ferrite, copper-zinc-magnesium ferrite, manganese ferrite, and magnesium ferrite are preferable, from the viewpoint of triboelectric chargeability, and ferrite, copper-zinc-magnesium ferrite, manganese ferrite, and magnesium ferrite are more preferable, from the viewpoint of image quality.

It is preferable that the surface of the carrier is coated with a resin, from the viewpoint of reducing the contamination of the carrier. The resin for coating the surface of the carrier may vary depending upon the toner materials, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. These resins can be used alone or in admixture of two or more kinds. In the case where the toner is negatively chargeable, silicone resins are preferable, from the viewpoint of triboelectric chargeability and surface energy. The method of coating a core material with a resin is not particularly limited, and includes, for example, a method of dissolving or suspending a coating material such as a resin in a solvent, and applying the solution or suspension to be deposited on a core material, a method of simply blending in the state of powder, and the like.

In the two component developer of the present invention obtained by mixing a toner and a carrier, a weight ratio of the toner to the carrier, i.e. toner/carrier, is preferably from 1/99 to 10/90, and more preferably from 5/95 to 7/93.

EXAMPLES

The following examples further describe and demonstrate embodiments of the present invention. The examples are given solely for the purposes of illustration and are not to be construed as limitations of the present invention.

[Softening Point of Resins]

The softening point refers to a temperature at which a half of the sample flows out, when plotting a downward movement of a plunger of a flow tester (Shimadzu Corporation, "CFT-500D"), against temperature, in which a sample is prepared by applying a load of 1.96 MPa thereto with the plunger using the flow tester and extruding a 1 g sample through a nozzle having a die pore size of 1 mm and a length of 1 mm, while heating the sample so as to raise the temperature at a rate of 6° C./min.

[Softening Point of Rosin]

(1) Preparation of Samples

Ten grams of a rosin is melted on hot plate at 170° C. for 2 hours. Thereafter, the molten rosin is air-cooled in an environment of an open state at a temperature of 25° C. and relative humidity of 50%, and a cooled product is pulverized with a coffee mill (National Panasonic MK-61M) for 10 seconds.

(2) Measurement

The softening point refers to a temperature at which a half of the sample flows out, when plotting a downward movement of a plunger of a flow tester (Shimadzu Corporation, "CFT-500D"), against temperature, in which a sample is prepared by applying a load of 1.96 MPa thereto with the plunger using the flow tester and extruding a 1 g sample through a nozzle having a die pore size of 1 mm and a length of 1 mm, while heating the sample so as to raise the temperature at a rate of 6° C./min.

[Glass Transition Temperature of Resins]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter (Seiko Instruments, Inc., "DSC 210") of a sample of which temperature is raised at a rate of 10° C./min., the sample prepared by measuring out a sample in an amount of from 0.01 to 0.02 g on an aluminum pan, raising its temperature to 200° C., and cooling the sample from that temperature to 0° C. at a cooling rate of 10° C./min.

[Acid Values of Resins and Rosin]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio)).

[Melting Point of Releasing Agent]

A temperature of maximum endothermic peak obtained by raising the temperature of a sample at a rate of 10° C./min., the sample prepared by raising the temperature of a sample to 200° C. using a differential scanning calorimeter (Seiko Instruments, Inc., "DSC 210"), and cooling the heated sample from that temperature to 0° C. at a cooling rate of 10° C./min., is referred to as a melting point.

[Number-Average Particle Size of External Additive]

The number-average particle size is obtained by the following formula:

$$\text{Number-Average Particle Size (nm)} = 6/(\rho \times \text{Specific Surface Area } (m^2/g)) \times 1000$$

In the formula, ρ is a specific gravity of a fine inorganic powder or an external additive; and Specific Surface Area is a BET specific surface area obtained by nitrogen adsorption method of a raw powder, or a raw powder before the hydrophobic treatment in the case of an external additive. For example, the specific gravity of silica is 2.2, and the specific gravity of titanium oxide is 4.2.

Incidentally, the above formula is obtained from:

$$\text{BET Specific Surface Area} = S \times (1/m)$$

wherein $m(\text{Mass of A Particle}) = 4/3 \times \pi \times (R/2)^3 \times \text{Density}$, and $$S\ (\text{Surface Area}) = 4\pi(R/2)^2,$$

assuming a sphere having a particle size R.

[Volume-Median Particle Size ($D_{50}$) of Toner]

Measuring Apparatus: Coulter Multisizer II (manufactured by Beckman Coulter)

Aperture Diameter: 100 μm

Analyzing Software: Coulter Multisizer AccuComp Ver. 1.19 (manufactured by Beckman Coulter)

Electrolytic Solution: "Isotone II" (manufactured by Beckman Coulter)

Dispersion: "EMULGEN 109P" (manufactured by Kao Corporation, polyoxyethylene lauryl ether, HLB: 13.6) is dissolved in the above electrolytic solution so as to have a concentration of 5% by weight to give a dispersion.

Dispersion Conditions: Ten milligrams of a measurement sample is added to 5 ml of the above dispersion, and the mixture is dispersed for 1 minute with a ultrasonic disperser, and 25 ml of an electrolytic solution is added to the dispersion, and further dispersed with a ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

Purification Example of Rosin

A 2000-ml distillation flask equipped with a fractionation tube, a reflux condenser and a receiver was charged with 1000 g of a tall rosin, and the tall rosin was distilled under a reduced pressure of 13.3 kPa, and a fractionation component at 195° to 250° C. was collected as a main fractionation component, to be used in Resin Production Examples described below.

Twenty grams of the rosin was pulverized with a coffee mill (National Panasonic MK-61M) for 5 seconds, and the rosin having sizes of 1-mm sieve opening-passed were measured off in an amount of 0.5 g in a vial for headspace (20 ml). A headspace gas was sampled, and the results of analyzing impurities in the rosin by headspace GC-MS method are shown in Table 1.

[Measurement Conditions for Headspace GC-MS Method]

A. Headspace Sampler (manufactured by Agilent, "HP7694")

Sample Temperature: 200° C.;
Loop Temperature: 200° C.;
Transfer Line Temperature: 200° C.;
Equilibrating Time for Sample Heating: 30 min.;
Vial Pressure Gas: Helium (He);
Vial Pressing Time: 0.3 min.;
Loop Filling Time: 0.03 min.;
Loop Equilibrating Time: 0.3 min.; and
Charging Time: 1 min.

B. GC (Gas Chromatography) (manufactured by Agilent, "HP6890")

Analyzing Column: DB-1 (60 m-320 μm-5 μm);
Carrier: Helium (He);
Flow Rate Conditions: 1 ml/min.;
Charging Inlet Temperature: 210° C.;
Column Head Pressure: 34.2 kPa;
Charging Mode: split;
Split Ratio: 10:1; and
Oven Temperature Conditions: 45° C. (3 min.)-10° C./min.-280° C. (15 min.).

C. MS (Mass Spectroscopy) (manufactured by Agilent, "HP5973")

Ionization Method: EI (Electron Impact) method;
Interface Temperature: 280° C.;
Ion Source Temperature: 230° C.;
Quadrupole Temperature: 150° C.; and
Detection Mode: Scan 29-350 m/s.

TABLE 1

| | Hexanoic Acid | Pentanoic Acid | Benz-aldehyde | n-Hexanal | 2-Pentyl-furan | Softening Point (° C.) | Acid Value (mg KOH/g) |
|---|---|---|---|---|---|---|---|
| Rosin | $0.6 \times 10^7$ | $0.4 \times 10^7$ | $0.4 \times 10^7$ | $1.6 \times 10^7$ | $0.9 \times 10^7$ | 75.0 | 167 |

Resin Production Example 1

A 5-liter four-necked flask equipped with a nitrogen inlet tube, a dehydration tube, a stirrer and a thermocouple was charged with an alcohol component, terephthalic acid, and an esterification catalyst, as shown in Tables 2 and 3, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., the rosin was introduced into the mixture, and the mixture was allowed to react at 200° C. for 15 hours. After cooling the mixture to a temperature of 180° C., itaconic acid was introduced into the mixture, and the mixture was allowed to react at 200° C. for 8 hours. After cooling the mixture to a temperature of 180° C., trimellitic anhydride was introduced into the mixture, and the mixture was heated to a temperature of 210° C. over 2 hours. The mixture was allowed to react at 210° C. and 10 kPa until a desired softening point was reached, to give each of polyesters (Resins H-0 and L-0).

Resin Production Example 2

A 5-liter four-necked flask equipped with a nitrogen inlet tube, a dehydration tube, a stirrer and a thermocouple was charged with an alcohol component, terephthalic acid, and an esterification catalyst, as shown in Table 3, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., itaconic acid was introduced into the mixture, and the mixture was heated to a temperature of 210° C. over 2 hours. The mixture was allowed to react at 210° C. and 10 kPa until a desired softening point was reached, to give a polyester (Resin L-1).

Resin Production Example 3

A 5-liter four-necked flask equipped with a nitrogen inlet tube, a dehydration tube, a rectification tower, a stirrer and a thermocouple was charged with an alcohol component, terephthalic acid, and an esterification catalyst, as shown in Table 2, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., trimellitic anhydride was introduced into the mixture, and the mixture was heated to a temperature of 210° C. over 3 hours. The mixture was allowed to react at a normal pressure for 10 hours, and then allowed to react at 210° C. and 20 kPa until a desired softening point was reached, to give each of polyesters (Resins H-1 to H-3).

Resin Production Example 4

A 5-liter four-necked flask equipped with a nitrogen inlet tube, a dehydration tube, a rectification tower, a stirrer and a thermocouple was charged with an alcohol component, terephthalic acid, and an esterification catalyst, as shown in Tables 2 and 3, and the mixture was subjected to a polycondensation reaction at 230° C. for 15 hours under nitrogen atmosphere, and thereafter the mixture was allowed to react at 230° C. and 20 kPa until a desired softening point was reached, to give each of polyesters (Resins H-4, H-5, and L-2 to L-5).

Resin Production Example 5

A 5-liter four-necked flask equipped with a nitrogen inlet tube, a dehydration tube, a stirrer and a thermocouple was charged with an alcohol component, terephthalic acid, and an esterification catalyst, as shown in Table 4, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., the rosin was introduced into the mixture, and the mixture was allowed to react at 200° C. for 15 hours. After cooling the mixture to a temperature of 180° C., itaconic acid was introduced into the mixture, and the mixture was allowed to react at 200° C. for 8 hours. After cooling the mixture to a temperature of 180° C., trimellitic anhydride was introduced into the mixture, and the mixture was heated to a temperature of 210° C. over 2 hours. The mixture was allowed to react at 210° C. and 10 kPa until a desired softening point was reached, to give each of polyesters (Resins H-6 and H-7).

Resin Production Example 6

A 5-liter four-necked flask equipped with a nitrogen inlet tube, a dehydration tube, a stirrer and a thermocouple was charged with an alcohol component, terephthalic acid, and an esterification catalyst, as shown in Table 4, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., the rosin was introduced into the mixture, and the mixture was allowed to react at 200° C. for 15 hours. After cooling the mixture to a temperature of 180° C., trimellitic anhydride was introduced into the mixture, and the mixture was heated to a temperature of 210° C. over 2 hours. The mixture was allowed to react at 210° C. and 10 kPa until a desired softening point was reached, to give a polyester (Resin H-8).

Resin Production Example 7

A 5-liter four-necked flask equipped with a nitrogen inlet tube, a dehydration tube, a stirrer and a thermocouple was charged with an alcohol component, terephthalic acid, and an esterification catalyst, as shown in Table 4, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., the rosin was introduced into the mixture, and the mixture was allowed to react at 200° C. for 15 hours. After cooling the mixture to a temperature of 180° C., itaconic acid was introduced into the mixture, and the mixture was heated to a temperature of 210° C. over 2 hours. The mixture was allowed to react at 210° C. and 10 kPa until a desired softening point was reached, to give each of polyesters (Resins L-6 and L-7).

Resin Production Example 8

A 5-liter four-necked flask equipped with a nitrogen inlet tube, a dehydration tube, a stirrer and a thermocouple was charged with an alcohol component, terephthalic acid, and an esterification catalyst, as shown in Table 4, and the mixture was subjected to a polycondensation reaction at 230° C. for 15 hours under nitrogen atmosphere, and thereafter the reaction mixture was allowed to react at 230° C. and 8.0 kPa for 1 hour. After cooling the mixture to a temperature of 180° C., the rosin was introduced into the mixture, and the mixture was allowed to react at 200° C. for 15 hours. After cooling the mixture to a temperature of 180° C., trimellitic anhydride was introduced into the mixture, and the mixture was heated to a temperature of 210° C. over 2 hours. The mixture was allowed to react at 210° C. and 10 kPa until a desired softening point was reached, to give a polyester (Resin L-8).

TABLE 2

| | Resin H-0 | Resin H-1 | Resin H-2 | Resin H-3 | Resin H-4 | Resin H-5 |
|---|---|---|---|---|---|---|
| Alcohol Component | | | | | | |
| 1,3-Propanediol | 228 g (20) | 228 g (20) | — | — | 1142 g (100) | — |
| 1,2-Propanediol | 913 g (80) | 913 g (80) | 913 g (80) | 1142 g (100) | — | — |
| 2,3-Butanediol | — | — | — | — | — | 1350 g (100) |
| Glycerol | 276 g (20) | 276 g (20) | 276 g (20) | — | — | — |
| Carboxylic Acid Component | | | | | | |
| Terephthalic Acid | 2117 g (85) | 2117 g (85) | 1245 g (50) | 1743 g (70) | 1992 g (80) | 1992 g (80) |
| Itaconic Acid | 195 g (10) | — | — | — | — | — |
| Trimellitic Anhydride | 144 g (5) | 144 g (5) | 576 g (20) | 288 g (10) | — | — |
| Rosin | 498 g (10) | — | — | — | — | — |
| Esterification Catalyst | | | | | | |
| Dibutyltin Oxide | — | — | — | — | 0.5 | 0.5 |
| Tin (II) Dioctanoate | 0.5 | 0.5 | 0.5 | 0.5 | — | — |
| Physical Properties of Polyester | | | | | | |
| Softening Point (° C.) | 144.5 | 145.3 | 144.2 | 150.8 | 73.3 | 121.5 |
| Glass Transition Temp. (° C.) | 62.5 | 63.2 | 60.8 | 65.3 | 31.1 | 49.9 |

TABLE 2-continued

| | Resin H-0 | Resin H-1 | Resin H-2 | Resin H-3 | Resin H-4 | Resin H-5 |
|---|---|---|---|---|---|---|
| Acid Value (mgKOH/g) | 35.0 | 32.3 | 49.4 | 41.7 | 45.2 | 43.6 |

Note 1)

Values inside the parentheses in the amount of the alcohol component and the carboxylic acid component used are expressed by molar ratios.

Note 2)

The amount of the esterification catalyst used is expressed by a weight ratio to a total amount 100 parts by weight of the alcohol component and the carboxylic acid component.

TABLE 3

| | Resin L-0 | Resin L-1 | Resin L-2 | Resin L-3 | Resin L-4 | Resin L-5 |
|---|---|---|---|---|---|---|
| Alcohol Component | | | | | | |
| 1,3-Propanediol | — | — | — | — | 1142 g (100) | — |
| 1,2-Propanediol | 913 g (80) | 913 g (80) | 913 g (80) | 1142 g (100) | — | — |
| 2,3-Butanediol | — | — | — | — | — | 1350 g (100) |
| Glycerol | 276 g (20) | 276 g (20) | 276 g (20) | — | — | — |
| Carboxylic Acid Component | | | | | | |
| Terephthalic Acid | 1743 g (70) | 1992 g (80) | 1992 g (80) | 1992 g (80) | 1743 g (70) | 1743 g (70) |
| Itaconic Acid | 432 g (15) | 432 g (15) | — | — | — | — |
| Rosin | 1444 g (29) | — | — | — | — | — |
| Esterification Catalyst | | | | | | |
| Dibutyltin Oxide | — | — | — | — | 0.5 | 0.5 |
| Tin (II) Dioctanoate | 0.5 | 0.5 | 0.5 | 0.5 | — | — |
| Physical Properties of Polyester | | | | | | |
| Softening Point (° C.) | 107.0 | 105.3 | 101.6 | 105.0 | 86.2 | 80.5 |
| Glass Transition Temp. (° C.) | 58.8 | 57.2 | 56.6 | 58.5 | 40.8 | 38.9 |
| Acid Value (mgKOH/g) | 38.8 | 35.6 | 40.3 | 30.9 | 35.2 | 32.8 |

Note 1)

Values inside the parentheses in the amount of the alcohol component and the carboxylic acid component used are expressed by molar ratios assuming that a total amount of the alcohol component is 100

Note 2)

The amount of the esterifcation catalyst used is expressed by a weight ratio to a total amount 100 parts by weight of the alcohol component and the carboxylic acid component.

TABLE 4

| | Resin H-6 | Resin H-7 | Resin H-8 | Resin L-6 | Resin L-7 | Resin L-8 |
|---|---|---|---|---|---|---|
| Alcohol Component | | | | | | |
| 1,3-Propanediol | — | — | — | — | — | — |
| 1,2-Propanediol | 913 g (80) | 1142 g (100) | 1142 g (100) | 913 g (80) | 1142 g (100) | 1142 g (100) |
| 2,3-Butanediol | — | — | — | — | — | — |
| Glycerol | 276 g (20) | — | — | 276 g (20) | — | — |
| Carboxylic Acid Component | | | | | | |
| Terephthalic Acid | 1868 g (75) | 1245 g (50) | 1743 g (70) | 1967 g (79) | 1967 g (79) | 1743 g (70) |
| Itaconic Acid | 195 g (10) | 195 g (10) | — | 293 g (15) | 293 g (15) | — |
| Trimellitic Anhydride | 144 g (5) | 576 g (20) | 288 g (10) | — | — | 288 g (10) |
| Rosin | 498 g (10) | 996 g (20) | 996 g (20) | 1444 g (29) | 1444 g (29) | 1743 g (35) |
| Esterification Catalyst | | | | | | |
| Tin (II) Dioctanoate | 11.7 g (0.5) | 12.5 g (0.5) | 12.5 g (0.5) | 11.7 g (0.5) | 12.5 g (0.5) | 12.5 g (0.5) |
| Physical Properties of Polyester | | | | | | |
| Softening Point (° C.) | 145.3 | 144.2 | 150.8 | 105.3 | 101.6 | 105.0 |
| Glass Transition Temp. (° C.) | 63.2 | 60.8 | 65.3 | 57.2 | 55.6 | 58.5 |

TABLE 4-continued

| | Resin H-6 | Resin H-7 | Resin H-8 | Resin L-6 | Resin L-7 | Resin L-8 |
|---|---|---|---|---|---|---|
| Acid Value (mgKOH/g) | 32.3 | 49.4 | 41.7 | 35.6 | 40.3 | 30.9 |

Note 1)
Values inside the parentheses in the amount of the alcohol component and the carboxylic acid component used are expressed by molar ratios assuming that a total amount of the alcohol component is 100 mol.
Note 2)
Values inside the parentheses in the amount of the esterification catalyst used is expressed by a weight ratio to a total amount 100 parts by weight of the alcohol component and the carboxylic acid component.

Examples 1 to 4 and Comparative Examples 1 to 8

One-hundred parts by weight of a resin binder shown in Table 5, 4 parts by weight of a carbon black "MOGUL L" (manufactured by Cabot Corporation), 1 part by weight of a negatively chargeable charge control agent "BONTRON S-34" (manufactured by Orient Chemical Co., Ltd.), and 1 part by weight of a polypropylene wax "NP-105" (manufactured by MITSUI CHEMICALS, INC., melting point: 105° C.) were sufficiently mixed with a Henschel mixer, and thereafter the mixture was melt-kneaded using a unidirectional rotary twin-screw extruder at a rotational speed of a roller of 200 r/min. and a heating temperature inside the roller of 80° C. The resulting melt-kneaded mixture was cooled and roughly pulverized, the roughly pulverized product was then pulverized with a jet mill, and the pulverized product was classified to give a powder having a volume-median particle size ($D_{50}$) of 8.0 μm.

To 100 parts by weight of the resulting powder was added 1.0 part by weight of an external additive "Aerosil R-972" (manufactured by Nippon Aerosil Co., LTD., hydrophobic treatment agent: DMDS, number-average particle size: 16 nm), and the mixture was blended with a Henschel mixer, to give a toner

Test Example 1

Low-Temperature Fixing Ability and Offset Resistance

A toner was loaded on a printer "PAGEPRESTO N-4" (manufactured by CASIO COMPUTER CO., LTD., fixing: contact-fixing method, development method: nonmagnetic monocomponent development method, developer roller diameter: 2.3 cm), and an amount of toner adhesion was adjusted to 0.6 mg/cm$^2$, to give unfixed images. The obtained unfixed images were subjected to a fixing test by allowing unfixed images to fix while raising a temperature of the fixer roller from 100° to 250° C. with an increment of 10° C. using a fixing apparatus (fixing speed: 400 mm/s) modified so as to enable fixing outside the machine with a fixing apparatus of a contact-fixing type copy machine "AR-505" (manufactured by Sharp Corporation).

"UNICEF Cellophane" tape (manufactured by MITSUBISHI PENCIL CO., LTD., width: 18 mm, JIS Z-1522) was adhered to the fixed images obtained at each fixing temperature, and the resulting fixed images were allowed to pass through the fixing roller of the above fixing apparatus set at 30° C., and the tape was then removed. The optical reflective densities before and after the removal of the tape were measured using a reflective densitometer "RD-915" (manufactured by Macbeth Process Measurements Co.). A temperature of the fixing roller at which the ratio of both of the optical reflective densities, i.e. that after removal/that before removal, initially exceeds 95% is defined as a lowest fixing temperature. The low-temperature fixing ability was evaluated in accordance with the following evaluation criteria. In addition, the hot offset generating temperature was confirmed at the same time, and the offset resistance was evaluated in accordance with the following evaluation criteria. The results are shown in Table 5.

[Evaluation Criteria for Low-Temperature Fixing Ability]

◎◎: The lowest fixing temperature is lower than 150° C.

◎: The lowest fixing temperature is 150° C. or higher and lower than 160° C.

○: The lowest fixing temperature is 160° C. or higher and lower than 170° C.

Δ: The lowest fixing temperature is 170° C. or higher and lower than 180° C.

x: The lowest fixing temperature is 180° C. or higher.

[Evaluation Criteria for Offset Resistance]

◎◎: The hot offset generating temperature is 250° C. or higher.

◎: The hot offset generating temperature is 240° C. or higher and lower than 250° C.

○: The hot offset generating temperature is 230° C. or higher and lower than 240° C.

Δ: The hot offset generating temperature is 190° C. or higher and lower than 230° C.

x: The hot offset generating temperature is 180° C. or higher and lower than 190° C.

xx: The hot offset generating temperature is lower than 180° C.

Test Example 2

Storage Property

Four grams of a toner was placed in an open-type cylindrical vessel having a diameter of 5 cm and a height of 2 cm, and the toner was allowed to stand under environmental conditions of a temperature of 45° C. and a relative humidity of 65% for 72 hours. After allowing the toner to stand, the vessel containing the toner was gently shaken, and the presence or absence of the generation of toner aggregation was visually observed. The storage property was evaluated in accordance with the following evaluation criteria. The results are shown in Table 5.

[Evaluation Criteria]

◎: The toner aggregation is not found at all.

○: One or two lumps of toner aggregation is observed.

Δ: Three to five lumps of toner aggregation is observed.

x: Six or more lumps of toner aggregation is observed.

Test Example 4

Triboelectric Stability

Forty grams of a toner obtained was mixed with 960 g of a resin-coated ferrite carrier to give a developer. Each of the developers was allowed to stand under high-temperature, high-humidity conditions of a temperature of 35° C. and a relative humidity of 85% for a whole day and night. The triboelectric charges before and after allowing the developer to stand were measured by blow-off method. The triboelectric charges were evaluated in accordance with the following evaluation criteria. The results are shown in Table 5.

Δ: The melt adhesion of toner is confirmed in 3 to 5 locations on the photoconductor but hardly affecting the fixed images.

x: The melt adhesion of toner is confirmed in 6 or more locations on the photoconductor, generating defects in the fixed images.

TABLE 5

| | Resin Binders | | | | | | | | |
|---|---|---|---|---|---|---|---|---|---|
| | Resin H | Amount Used | Resin L | Amount Used | Low-Temp. Fixing Ability | Storage Property | Triboelectric Stability | Offset Resistance | Filming Resistance |
| Ex. 1 | H-0 | 50 | L-0 | 50 | ◎◎ | ◎ | ◎ | ◎◎ | ◎ |
| Ex. 2 | H-1 | 50 | L-1 | 50 | ◎ | ◎ | ○ | ◎◎ | ◎ |
| Ex. 3 | H-2 | 50 | L-2 | 50 | ◎ | ○ | ○ | ◎ | ○ |
| Ex. 4 | H-3 | 50 | L-3 | 50 | ○ | ○ | ○ | ○ | ○ |
| Comp. Ex. 1 | H-4 | 50 | L-4 | 50 | Δ | X | X | XX | X |
| Comp. Ex. 2 | H-5 | 50 | L-5 | 50 | X | X | X | X | X |
| Comp. Ex. 3 | H-6 | 100 | — | — | X | ◎ | Δ | ○ | Δ |
| Comp. Ex. 4 | H-7 | 100 | — | — | X | ○ | Δ | ○ | Δ |
| Comp. Ex. 5 | H-8 | 100 | — | — | X | ○ | Δ | ○ | Δ |
| Comp. Ex. 6 | — | — | L-6 | 100 | Δ | ○ | Δ | X | ◎ |
| Comp. Ex. 7 | — | — | L-7 | 100 | Δ | ○ | Δ | X | ○ |
| Comp. Ex. 8 | — | — | L-8 | 100 | Δ | ◎ | Δ | X | ○ |

Note)
Amount Used is expressed by parts by weight.
*Roll-on of sheets to a fixer roller is generated.

[Evaluation Criteria]

A change in triboelectric charges before and after allowing the developer to stand, i.e. difference in triboelectric charges before and after standing/triboelectric charges before standing×100, is:

◎: within 10%, thereby being very favorable;

○: greater than 10% and within 20%, thereby being favorable;

Δ: greater than 20% and within 30%, thereby being practically usable; and x: greater than 30%, thereby being failure.

Test Example 5

Filming Resistance

A toner was loaded on a modifying apparatus (linear speed: 370 mm/sec) of a copy machine "AR-505" (manufactured by Sharp Corporation), and 600,000 sheets of images having a printed ratio of 5% were continuously printed. After printing, the condition of the generation of melt adhesion of the residual toner onto a surface of a photoconductive drum and the influence to print-out fixed images were visually observed. The filming resistance was evaluated in accordance with the following evaluation criteria. The results are shown in Table 5.

[Evaluation Criteria]

◎: The melt adhesion of toner is not generated.

○: The melt adhesion of toner is confirmed in 1 or 2 locations on the photoconductor but hardly affecting the fixed images.

It can be seen from the above results that the toners of Examples having favorable results in both of low-temperature fixing ability and storage property are obtained, and further that the toners of Examples also have triboelectric stability, offset resistance and filming resistance, as compared to those of the toners of Comparative Examples.

The toner obtained according to the present invention can be used in the development of a latent image formed in, for example, electrophotography, electrostatic recording method, electrostatic printing method, or the like.

The invention claimed is:

1. A toner comprising a resin binder and a colorant, wherein said resin binder comprises a polyester (A) having a softening point Tm(A) of from 100° to 160° C., and a polyester (B) having a softening point Tm(B) of from 80° to 120° C., the softening point of which is lower than that of the polyester (A) by 5° C. or more, each polyester obtained by polycondensing an alcohol component and a carboxylic acid component, wherein the polyester (A) and/or (B) is a polyester obtained by polycondensing an alcohol component consisting essentially of an aliphatic alcohol, wherein the alcohol component comprises a dihydric alcohol component comprising 1,2-propanediol in an amount of 65% by mol or more, and a carboxylic acid component, wherein said carboxylic acid component of the polyester (A) and/or (B) comprises a purified rosin having a softening point of from 50° to 100° C.

2. The toner according to claim 1, wherein the alcohol component of the polyester (A) and/or (B) further comprises glycerol.

3. The toner according to claim 2, wherein the alcohol component comprises glycerol in an amount of from 5 to 40% by mol.

4. The toner according to claim 1, wherein the alcohol component of the polyester (A) further comprises 1,3-propanediol.

5. The toner according to claim 4, wherein a molar ratio of 1,2-propanediol to 1,3-propanediol in the alcohol component of the polyester (A) is from 99/1 to 65/35.

6. The toner according to claim 1, wherein the carboxylic acid component of the polyester (A) and/or (B) comprises an aliphatic dicarboxylic acid compound having 2 to 4 carbon atoms.

7. The toner according to claim 1, wherein a weight ratio of the polyester (A) to the polyester (B) (polyester (A)/polyester (B)) is from 1/9 to 9/1.

8. The toner according to claim 1, wherein a difference between Tm(A) and Tm(B) is 10° C. or more.

9. The toner according to claim 1, wherein the polyester (A) and/or (B) is a polyester obtained by polycondensing an alcohol component and a carboxylic acid component in the presence of one or more compounds selected from the group consisting of a titanium compound and a tin(II) compound without containing a Sn—C bond.

10. The toner according to claim 1, wherein the carboxylic acid component comprises the purified rosin in an amount of from 2 to 50% by mol.

11. The toner according to claim 1, wherein the carboxylic acid component comprises the purified rosin in an amount of from 5 to 40% by mol.

12. The toner according to claim 1, wherein the carboxylic acid component comprises the purified rosin in an amount of from 10 to 30% by mol.

13. The toner according to claim 1, wherein the purified rosin has an acid value of from 100 to 200 mg KOH/g.

14. The toner according to claim 1, wherein the purified rosin has an acid value of from 130 to 180 mg KOH/g.

15. The toner according to claim 1, wherein the purified rosin has an acid value of from 150 to 170 mg KOH/g.

16. The toner according to claim 1, wherein the purified rosin has a softening point of from 50° to 100° C.

17. The toner according to claim 1, wherein the purified rosin has a softening point of from 60° to 90° C.

18. The toner according to claim 1, wherein the purified rosin has a softening point of from 65° to 85° C.

* * * * *

UNITED STATES PATENT AND TRADEMARK OFFICE

CERTIFICATE OF CORRECTION

PATENT NO. : 8,236,470 B2
APPLICATION NO. : 12/094737
DATED : August 7, 2012
INVENTOR(S) : Yoshihiro Ueno et al.

It is certified that error appears in the above-identified patent and that said Letters Patent is hereby corrected as shown below:

Delete the title page and substitute therefor the attached title page with the corrected number of claims.

Delete the text of Claim 16 at Column 22, lines 16-17 in its entirety and replace with the following:

--16. The toner according to claim 1, wherein the purified rosin has a softening point of from 60° to 90° C.--

Delete the text of Claim 17 at Column 22, lines 18-19 in its entirety and replace with the following:

--17. The toner according to claim 1, wherein the purified rosin has a softening point of from 65° to 85° C.--

Delete Claim 18 at Column 22, lines 20-21 in its entirety.

Signed and Sealed this
Sixteenth Day of October, 2012

David J. Kappos

David J. Kappos
*Director of the United States Patent and Trademark Office*

(12) United States Patent
Ueno et al.

(10) Patent No.: US 8,236,470 B2
(45) Date of Patent: Aug. 7, 2012

(54) TONER

(75) Inventors: Yoshihiro Ueno, Wakayama (JP); Takashi Kubo, Wakayama (JP); Yasunori Inagaki, Wakayama (JP); Yoshitomo Kimura, Wakayama (JP)

(73) Assignee: Kao Corporation, Tokyo (JP)

( * ) Notice: Subject to any disclaimer, the term of this patent is extended or adjusted under 35 U.S.C. 154(b) by 691 days.

(21) Appl. No.: 12/094,737

(22) PCT Filed: Nov. 28, 2006

(86) PCT No.: PCT/JP2006/323712

§ 371 (c)(1),
(2), (4) Date: May 22, 2008

(87) PCT Pub. No.: WO2007/063847

PCT Pub. Date: Jun. 7, 2007

(65) Prior Publication Data

US 2010/0015545 A1 Jan. 21, 2010

(30) Foreign Application Priority Data

Dec. 2, 2005 (JP) ..... 2005-349085

(51) Int. Cl.
*G03G 9/087* (2006.01)

(52) U.S. Cl. ..... 430/109.4; 430/111.4

(58) Field of Classification Search ..... 430/109.4
See application file for complete search history.

(56) References Cited

U.S. PATENT DOCUMENTS

| | | | | |
|---|---|---|---|---|
| 4,863,824 | A * | 9/1989 | Uchida et al. | 430/109.4 |
| 4,981,939 | A | 1/1991 | Matsumura et al. | |
| 6,326,115 | B1 | 12/2001 | Nakanishi et al. | |
| 6,509,130 | B1 * | 1/2003 | Semura et al. | 430/109.4 |
| 6,653,435 | B1 | 11/2003 | Aoki et al. | |
| 7,232,636 | B2 * | 6/2007 | Semura et al. | 430/109.4 |
| 7,358,023 | B2 * | 4/2008 | Yamazaki et al. | 430/109.4 |
| 2003/0022088 | A1 | 1/2003 | Semura et al. | |
| 2005/0214670 | A1 * | 9/2005 | Matsumoto et al. | 430/109.4 |
| 2007/0281235 | A1 | 12/2007 | Ono et al. | |

FOREIGN PATENT DOCUMENTS

| | | |
|---|---|---|
| EP | 1 345 086 A2 | 9/2003 |
| JP | 63-127253 | 5/1988 |
| JP | 02-082267 | 3/1990 |
| JP | 03-267946 | 11/1991 |
| JP | 04-070765 | 3/1992 |
| JP | 07-286139 | 10/1995 |
| JP | 08-020636 | 1/1996 |
| JP | 10-239903 | 9/1998 |
| JP | 11-133668 | 5/1999 |
| JP | 2001-098055 | 4/2001 |
| JP | 2002-169331 | 6/2002 |
| JP | 2002-287427 | 10/2002 |
| JP | 2004-280084 A | 10/2004 |
| WO | WO 2005/057293 A1 | 6/2005 |

OTHER PUBLICATIONS

English language translation of JP 04-70765 (Mar. 1992).*

U.S. Appl. No. 12/302,843, filed Nov. 28, 2008, Kimura, et al.

Office Action mailed Aug. 12, 2011 in corresponding Japanese Application No. 2005-349085, filled Dec. 2, 2005. (with English translation).

Supplementary European Search Report issued in corresponding EP Application No. 06833516.5

Request for Inspection of File Record issued Nov. 15, 2011 and Observations by Third Party issued Oct. 20, 2011, in Japanese Patent Application No. 2005-349085 (with English-language translation)

Chinese Office Action issued Nov. 11, 2011, in Patent Application No. 201010586670.8 (with English-language translation).

Office Action mailed Apr. 2, 2012, in corresponding Japanese Patent Application 2005-349085 (with English-language translation).

Office Action Mailed May 23, 2012, in corresponding Chinese Patent Application 201010586670.8 (with English Translation) (8 pp.)

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner containing a resin binder and a colorant, wherein the resin binder contains a polyester (A) having a softening point Tm(A) of from 100° to 160° C., and a polyester (B) having a softening point Tm(B) of from 80° to 120° C., the softening point of which is lower than that of the polyester (A) by 5° C. or more, each polyester obtained by polycondensing an alcohol component and a carboxylic acid component, wherein the polyester (A) and/or (B) is a polyester obtained by polycondensing an alcohol component consisting essentially of an aliphatic alcohol, wherein the alcohol component contains a dihydric alcohol component containing 1,2-propanediol in an amount of 65% by mol or more, and a carboxylic acid component. The toner of the present invention is usable in the development or the like of a latent image formed in electrophotography, electrostatic recording method, electrostatic printing method, or the like.

17 Claims, No Drawings